US010763612B1

(12) United States Patent
Soroka et al.

(10) Patent No.: US 10,763,612 B1
(45) Date of Patent: Sep. 1, 2020

(54) ELECTRONIC CONNECTOR SEALING SYSTEM

(71) Applicant: HONEYWELL FEDERAL MANUFACTURING & TECHNOLOGIES, LLC, Kansas City, MO (US)

(72) Inventors: Ryan Michael Soroka, Overland Park, KS (US); David William Lindbloom, Lees Summit, MO (US)

(73) Assignee: Honeywell Federal Manufacturing & Technologies, LLC, Kansas City, MO (US)

( * ) Notice: Subject to any disclaimer, the term of this patent is extended or adjusted under 35 U.S.C. 154(b) by 0 days.

(21) Appl. No.: 16/545,692

(22) Filed: Aug. 20, 2019

(51) Int. Cl.
*H01R 13/52* (2006.01)
*H01R 13/436* (2006.01)
*H01R 11/28* (2006.01)

(52) U.S. Cl.
CPC ..... *H01R 13/5213* (2013.01); *H01R 11/284* (2013.01); *H01R 13/4367* (2013.01); *H01R 13/5208* (2013.01)

(58) Field of Classification Search
CPC ..... H01R 13/5208; H01R 13/4367; H01R 13/5221; H01R 13/5219; H01R 13/5213; H01R 13/5218; H01R 11/284
See application file for complete search history.

(56) References Cited

U.S. PATENT DOCUMENTS 2,930,835 A 3/1960 Bollmeier
3,496,500 A * 2/1970 Romary ..... H01R 13/523 335/205
5,097,213 A * 3/1992 Hunting ..... G01R 31/68 324/538
5,167,535 A * 12/1992 Kovacik ..... H01R 13/713 200/51 R
5,739,463 A 4/1998 Diaz et al.
6,433,445 B1 * 8/2002 Ahladas ..... H01R 13/641 307/117

(Continued)

OTHER PUBLICATIONS

RS Components Ltd [GB]; product page entitled: Glenair M83513 Series Cable Mount, 37 Pin D-sub Connector Socket Micro-D; Webpage https://uk.rs-online.com/web/p/solder-d-sub-connectors/7195912/.

(Continued)

*Primary Examiner* — Briggitte R. Hammond
(74) *Attorney, Agent, or Firm* — Hovey Williams LLP

(57) ABSTRACT

An electronic sealing system for sealing and shielding an electronic connector from detrimental liquid cleaners that are applied with or without pressure. The electronic sealing system includes a U-shaped holder, a gasket frame, a gasket, a top plate, and several fasteners. The U-shaped holder cradles the electronic connector. The gasket frame abuts a top side of the holder and includes an aperture. The gasket engages a portion of the connector via the aperture. The top plate abuts the gasket frame opposite the holder so as to encapsulate the gasket over the aperture and hence over a portion of the electronic connector. The fasteners secure the U-shaped holder, gasket frame, and top plate together so that the electronic connector is secured with the holder and so that a portion of the electronic connector is sealed via the gasket.

20 Claims, 3 Drawing Sheets

(56) References Cited

U.S. PATENT DOCUMENTS

| | | | | |
|---|---|---|---|---|
| 7,129,733 | B2 * | 10/2006 | Savagaonkar ..... | G01R 31/2886<br>324/754.03 |
| 8,299,803 | B2 | 10/2012 | Mackey et al. | |
| 2002/0157932 | A1 * | 10/2002 | DeWitt ..... | H01R 13/701<br>200/51.09 |
| 2004/0036273 | A1 * | 2/2004 | McClary ..... | H01R 13/641<br>285/18 |
| 2006/0245131 | A1 * | 11/2006 | Ramey ..... | H02J 7/0044<br>361/90 |
| 2009/0128977 | A1 * | 5/2009 | Christensen ..... | H02H 9/042<br>361/111 |

OTHER PUBLICATIONS

Farnell.com; webpage entitled 3M Mini D Ribbon (MDR) Cable Assembly; http://www.farnell.com/datasheets/80616.pdf.

* cited by examiner

ELECTRONIC CONNECTOR SEALING SYSTEM

GOVERNMENT INTERESTS

This invention was made with Government support under Contract No.: DE-NA0002839 awarded by the United States Department of Energy/National Nuclear Security Administration. The Government has certain rights in the invention.

BACKGROUND

Electronic circuits often include electronic connectors having pins and a connector gasket at the base of the pins. The electronic connectors are typically capped or masked as the electronic circuits are cleaned via surface mount aqueous cleaning, spray cleaning, and the like. Such cleaning often involves a cleaning solution and/or high pressure spray, which infiltrates around the cap or mask, resulting in unintended removal, dislodging, or delamination of the connector gasket. Cleaning solutions also cause pin damage and internal corrosion of and undesirable material interactions with the electronic connectors. The pins can also be damaged from electric shocks generated by static buildup (e.g., via tribocharging) in insulating features such as rubber gaskets.

SUMMARY

Embodiments of the invention solve the above-mentioned problems and other problems. More particular, the invention provides an electronic connector sealing system that more effectively protects a connector gasket and pins of an electronic connector of an electronic circuit as the electronic circuit is being cleaned and prevents electrical shocks to the pins.

An embodiment of the present invention is an electronic connector sealing system for sealing a female end of an electronic connector. The electronic connector sealing system broadly includes a holder, a gasket frame, a gasket, a top plate, a plurality of inner fasteners, and a plurality of outer fasteners.

The holder includes a top surface, a bottom surface, a ledge, an open slot, and left and right anchor holes. The holder may be U-shaped for positioning the electronic connector in the open slot in cradling engagement with the holder. The top surface contacts the gasket frame and may be substantially flat with the left and right anchor holes extending downward from the top surface.

The ledge extends at least partially around the open slot and contacts or abuts bottom surfaces of flanges of the electronic connector so as to at least partially surround a lower section of the electronic connector. The ledge may be a flange, a protrusion, a shelf, a boss, or any other suitable structure. A thickness of the ledge (i.e., a distance between a top of the ledge and the bottom surface of the holder) may be slightly smaller than a distance between the bottom surfaces of the flanges and a lower surface of the electronic connector so that a cleaning solution can pass between the holder and a printed circuit board (PCB) or printed wafer board (PWB) and interact with solder joints electronically connecting the electronic connector to the PCB or PWB.

The left and right anchor holes extend downward from the top surface of the holder for receiving distal ends of the outer fasteners therein. The left and right anchor holes may have helical threads for tightening bolts, screws, or the like.

The gasket frame includes a central aperture, a number of inner fastener through-holes, and left and right outer fastener through-holes. The gasket frame is configured to abut the top surface of the holder and may be a flat plate, a tab, a ring, or any other suitable structure.

The central aperture may be a large rectangular through-hole configured to receive at least a portion of the connector skirt of the electronic connector (and/or at least a portion of the gasket) at least partially therethrough. The central aperture may be slightly smaller than the gasket so that outer portions of the gasket overlay the gasket frame while the gasket covers the central aperture.

The inner fastener through-holes align with inner fastener through-holes of the top plate for receiving the inner fasteners therethrough. The spacing and positions of the inner fastener through-holes ensure that the gasket is evenly pressed between the gasket frame and the top plate. The outer fastener through-holes align with the anchor holes of the holder and outer fastener through-holes of the top plate for receiving the outer fasteners therethrough.

The gasket may be a rubber seal such as electrostatic discharge (ESD) safe rubber and may be substantially rectangular. The gasket may be slightly larger than the aperture of the gasket frame so that outer portions of the gasket overlay the gasket frame while the gasket covers the central aperture. The gasket engages a female connector skirt of the electronic connector and forms a seal therewith.

The top plate includes a gasket recess, a number of inner fastener through-holes, and left and right outer fastener through-holes. The top plate is configured to abut the gasket frame opposite the holder and may be a flat plate, a tab, a cap, or any other suitable structure.

The gasket recess extends into a lower surface of the top plate and at least partially receives the gasket therein. The gasket recess aligns the gasket over the central aperture of the gasket frame. To that end, the gasket recess may have a similar shape as the gasket.

The inner fastener through-holes of the top plate align with the inner fastener through-holes of the gasket frame and may be threaded for anchoring top ends of the inner fasteners. The spacing and positions of the inner fastener through-holes of the top plate ensure that the gasket is evenly pressed between the gasket frame and the top plate. The outer fastener through-holes of the top plate align with the outer fastener through-holes of the gasket frame and the anchor holes of the holder for receiving the outer fasteners therethrough.

The electronic connector sealing system forms a seal with the female connector skirt of the electronic connector via the gasket so as to prevent aqueous cleaner and/or high pressure spray from removing, dislodging, or delaminating the connector gasket or damaging pins of the electronic connector. The electronic connector sealing system also allows for surface mount cleaning around the electronic connector via the vertical gap below the holder. The electronic connector sealing system can also be used with electronic connectors of different sizes and shapes.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figures 1, 2:
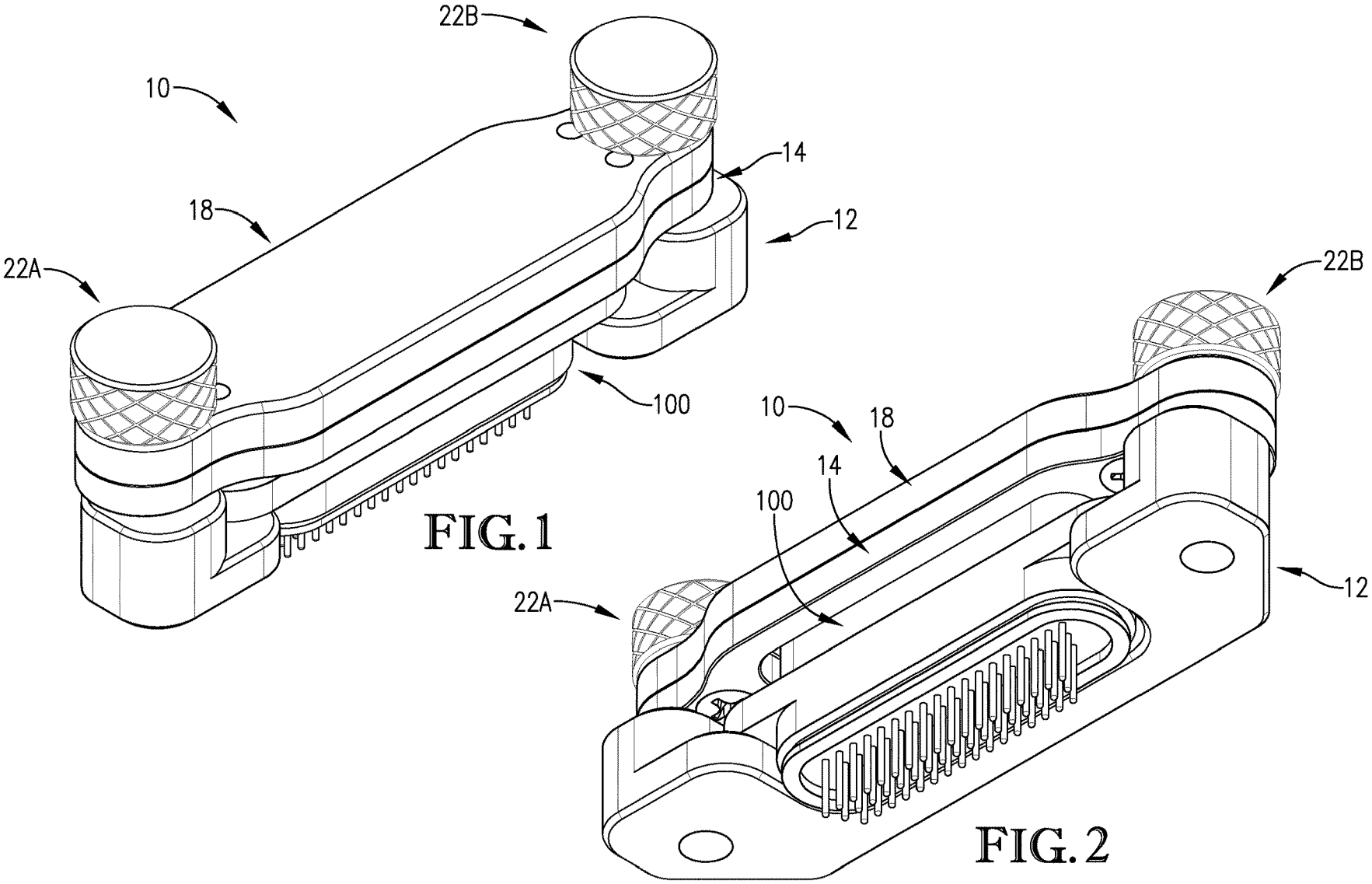
FIG. 1 is a top perspective view of an electronic connector sealing system constructed in accordance with an embodiment of the invention.
FIG. 2 is a bottom perspective view of the electronic connector sealing system of claim 1.
Figure 3:
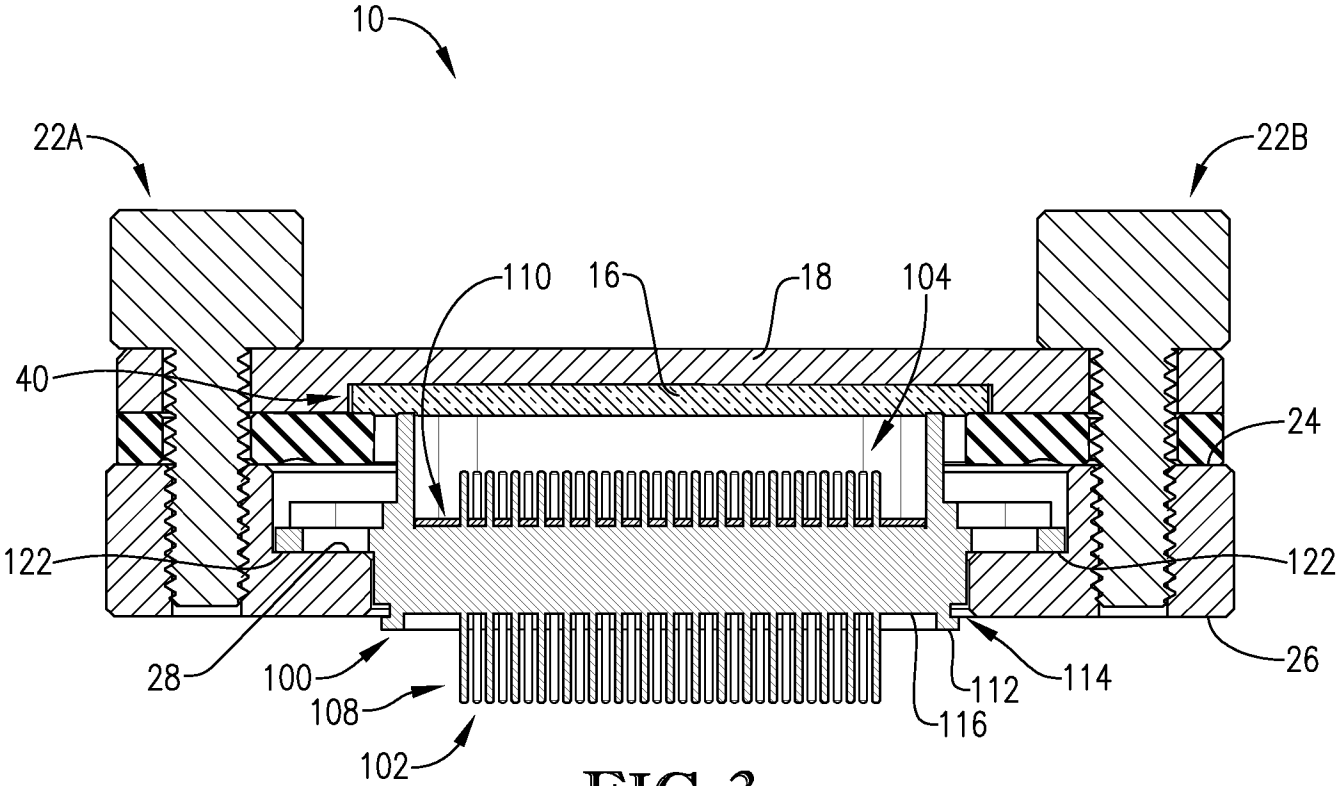
FIG. 3 is a front cutaway elevation view of the electronic connector sealing system of claim 1.
Figure 4:
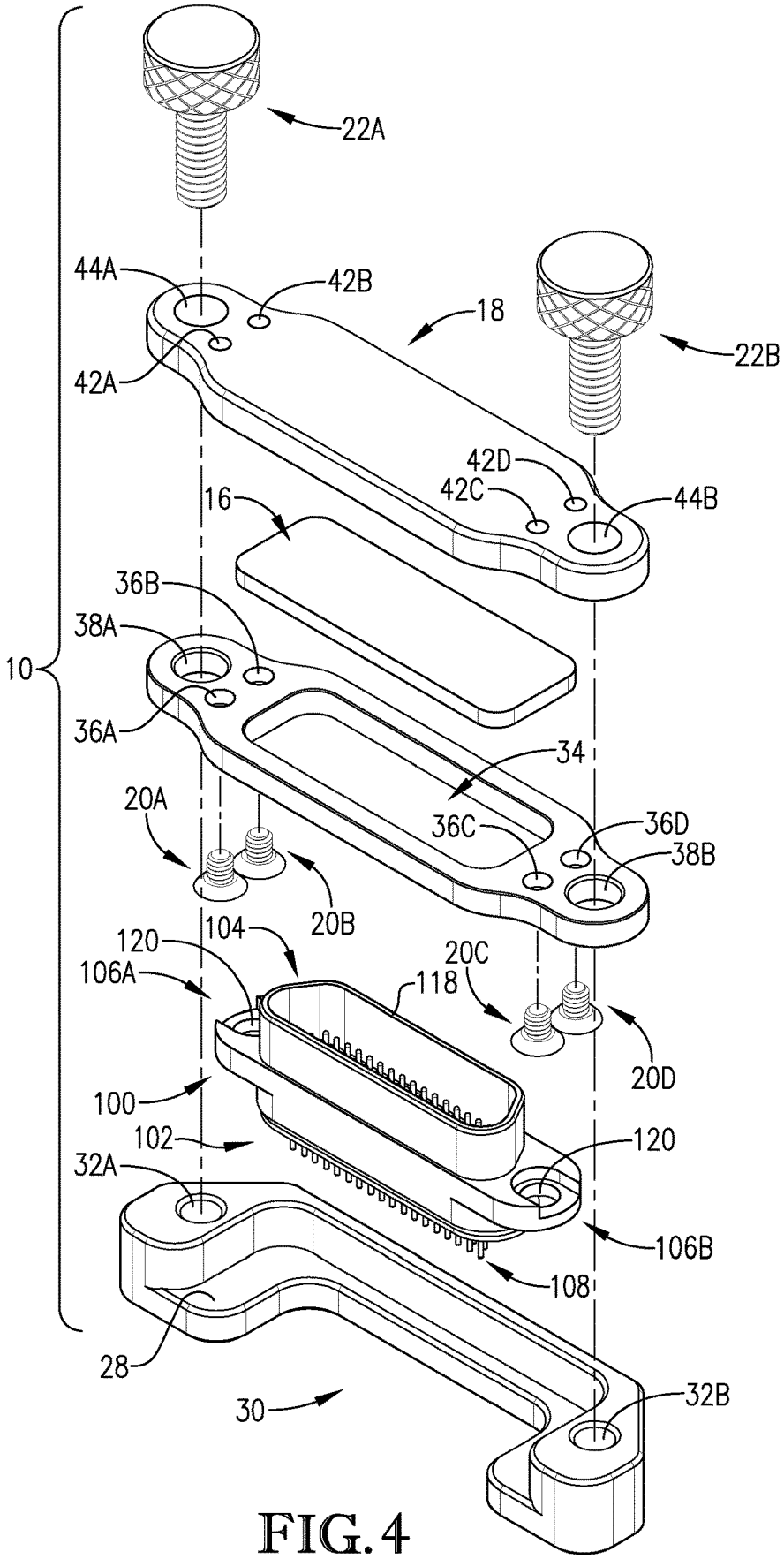
FIG. 4 is a perspective exploded view of the electronic connector sealing system of claim 1.

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the current technology can include a variety of combinations and/or integrations of the embodiments described herein.

Turning now to the drawing figures, an electronic connector sealing system 10 constructed in accordance with an embodiment of the invention is illustrated. The electronic connector sealing system 10 broadly comprises a holder 12, a gasket frame 14, a gasket 16, a top plate 18, a plurality of inner fasteners 20A-D, and a plurality of outer fasteners 22A,B.

The electronic connector sealing system 10 may be used to seal an electronic connector 100 having a lower section 102, an upper section 104, left and right flanges 106A,B, a plurality of connector pins 108, and a connector gasket 110. The lower section 102 may include a lower surface 112, a circumferential groove 114, and a pin bed 116. The lower surface 112 may be positioned near a PCB, a PWB, another electronic connector, or the like. The circumferential groove 114 may engage with clips, fasteners, solder, securement geometry, and the like. The pin bed 116 anchors the connector pins 108 and may be recessed from the lower surface 112.

The upper section 104 may include a female connector skirt 118 that encircles the connector pins 108. The female connector skirt 118 may be substantially rectangular, trapezoidal, or any other suitable shape. Alternatively, socketed pins may be used.

The flanges 106A,B extend laterally from left and right sides of the electronic connector 100 and each includes a fastener through-hole 120 and a bottom surface 122 that will be abutted by a ledge of the holder 12 as described below.

The connector pins 108 extend vertically from below the lower section 102 into the upper section 104 so as to be encircled by the connector skirt 118. The connector pins 108 are configured to be electronically connected to circuit leads, circuit traces, and/or vias on the PWB or PCB, wires, or other electronic connectors. In one embodiment, the electronic connector 100 includes 51 connector pins although any number of connector pins, electronic contacts, and the like may be used.

The connector gasket 110 surrounds the connector pins 108 in the upper section 104 and may be Silicone or any other suitable non-conductive material. The connector gasket 110 protects the connector pins 108 and helps keep them separated. The connector gasket 110 may also have electromagnetic interference (EMI) shielding properties. The connector gasket 110 may be secured in place via an adhesive such as RTV 732 sealant or the like.

The holder 12 includes a top surface 24, a bottom surface 26, a ledge 28, an open slot 30, and left and right anchor holes 32A,B. The holder 12 may be U-shaped for positioning the electronic connector 100 in the open slot 30 in cradling engagement with the holder 12. The top surface 24 contacts the gasket frame 14 and may be substantially flat with the left and right anchor holes 32A,B extending downward from the top surface 24. The bottom surface 26 opposes the top surface 24.

The ledge 28 extends at least partially around the open slot 30 and contacts or abuts the bottom surfaces 122 of the flanges 106A,B of the electronic connector 100 so as to at least partially surround the lower section 102 of the electronic connector 100. The ledge 28 may be a flange, a protrusion, a shelf, a boss, or any other suitable structure. A thickness of the ledge 28 (i.e., a distance between a top of the ledge 28 and the bottom surface 26 of the holder 12) may be slightly smaller than a distance between the bottom surfaces 122 of the flanges 106A,B and the lower surface 112 of the electronic connector 100 so that a cleaning solution can pass between the holder 12 and the PCB or PWB and interact with solder joints electronically connecting the electronic connector 100 to the PCB or PWB. That is, when the holder 12 is cradling the electronic connector 100, the lower surface 112 of the electronic connector 100 extends below the bottom surface 26 of the holder 12. In one embodiment, a vertical gap of approximately 0.025 inches is formed below the holder 12 when it cradles the electronic connector 100.

The open slot 30 receives the electronic connector 100 from a front side or a top of the holder 12. The open slot 30 may be at least partially shaped complementary to a shape of the electronic connector 100 or may have a universal shape for receiving electronic connectors of various shapes.

The left and right anchor holes 32A,B extend downward from the top surface 24 of the holder 12 for receiving distal ends of the outer fasteners 22A,B therein. The left and right anchor holes 32A,B may have helical threads for tightening bolts, screws, or the like. Although only one anchor hole is shown for each side, any number of anchor holes may be used.

The gasket frame 14 includes a central aperture 34, a number of inner fastener through-holes 36A-D, and left and right outer fastener through-holes 38A,B. The gasket frame 14 is configured to abut the top surface 24 of the holder 12 and may be a flat plate, a tab, a ring, or any other suitable structure. The gasket frame 14 may have left and right tapered ends.

The central aperture 34 may be a large rectangular through-hole configured to receive at least a portion of the electronic connector (and/or at least a portion of the gasket 16) at least partially therethrough. The central aperture 34 may be slightly smaller than the gasket 16 so that outer portions of the gasket 16 overlay the gasket frame 14 while the gasket 16 covers the central aperture 34.

The inner fastener through-holes 36A-D align with inner fastener through-holes of the top plate 18. Although four inner fastener through-holes are shown, any number of inner fasteners (and hence any number of inner fastener through-holes) may be used. The inner fastener through-holes 36A-D ensure that the gasket 16 is evenly pressed between the gasket frame 14 and the top plate 18. This prevents leak points from forming around the gasket 16. In one embodiment, the inner fastener through-holes 36A-D are countersunk from below for receiving upward facing countersunk fasteners.

The outer fastener through-holes 38A,B align with outer fastener through-holes of the top plate 18 and the anchor holes 32A,B of the holder 12 for receiving the outer fasteners 22A,B therethrough. Although only two outer fastener through-holes are shown, any number of outer fasteners (and hence any number of outer fastener through-holes) may be used.

The gasket 16 may be a rubber seal such as electrostatic discharge (ESD) safe rubber and may be substantially rectangular. The gasket 16 may be slightly larger than the aperture 34 of the gasket frame 14 so that outer portions of the gasket 16 overlay the gasket frame 14 while the gasket 16 covers the central aperture 34.

The top plate 18 includes a gasket recess 40, a number of inner fastener through-holes 42A-D, and left and right outer fastener through-holes 44A,B. The top plate 18 is configured to abut the gasket frame 14 opposite the holder 12 and may be a flat plate, a tab, a cap, or any other suitable structure. The top plate 18 may have left and right tapered ends.

The gasket recess 40 extends into a lower surface of the top plate 18 and at least partially receives the gasket 16 therein. The gasket recess 40 aligns the gasket 16 over the central aperture 34 of the gasket frame 14. To that end, the gasket recess 40 may have a similar shape as the gasket 40.

The inner fastener through-holes 42A-D align with the inner fastener through-holes 36A-D of the gasket frame 14. The inner fastener through-holes 42A-D may be threaded for anchoring top ends of the inner fasteners 20. Although four inner fastener through-holes are shown, any number of inner fasteners (and hence any number of inner fastener through-holes) may be used. The inner fastener through-holes 42A-D ensure that the gasket 16 is evenly pressed between the gasket frame 14 and the top plate 18. This prevents leak points from forming around the gasket 16.

The outer fastener through-holes 44A,B align with the outer fastener through-holes 38A,B of the gasket frame 14 and the anchor holes 32A,B of the holder 12 for receiving the outer fasteners 22A,B therethrough. Although only two outer fastener through-holes are shown, any number of outer fasteners (and hence any number of outer fastener through-holes) may be used.

The inner fasteners 20A-D are configured to be inserted upward through the inner through-holes 36A-D of the gasket frame 14 and into the inner through-holes 42A-D of the top plate 18 so as to secure the gasket frame 14, the gasket 16, and the top plate 18 together. The inner fasteners 20A-D may be countersunk bolts, screws, pins, clips, or any other suitable fasteners.

The outer fasteners 22A,B are configured to be inserted downward through the outer fastener through-holes 44A,B of the top plate 18 and the outer fastener through-holes 38A,B of the gasket frame 14, and into the anchor holes 32A,B of the holder 12. The outer fasteners 22A,B may be bolts, screws, pins, clips, or any other suitable fasteners.

The above-described electronic connector sealing system 10 provides several advantages. For example, the electronic connector sealing system 10 forms a seal with the female connector skirt 118 of the electronic connector 100 via the gasket 16 so as to prevent aqueous cleaner and/or high pressure spray from removing, dislodging, or delaminating the connector gasket 110 or damaging the pins 108. The electronic connector sealing system 10 also allows for surface mount cleaning around the electronic connector 100 via the vertical gap below the holder 12. The electronic connector sealing system 10 can also be used with electronic connectors of different sizes and shapes. The electronic connector sealing system 10 also reduces static buildup and thus prevents electrical shock damage to the connector pins 108.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

The invention claimed is:

1. An electronic connector sealing system for sealing an electronic connector, the electronic connector sealing system comprising:

a holder configured to cradle the electronic connector;

a gasket frame configured to abut the holder, the gasket frame including an aperture configured to receive at least a portion of the electronic connector at least partially therethrough;

a gasket configured to engage the at least a portion of the connector received at least partially through the aperture so as to form a seal between the gasket and the connector; and a top plate configured to abut the gasket frame opposite the holder such that at least a portion of the gasket is positioned between the gasket frame and the top plate, the holder, the gasket frame, and the top plate being configured to be secured together so that the electronic connector is retained with the holder and so that the gasket is retained between the gasket frame and the top plate.

2. The electronic connector sealing system of claim 1, the holder including a ledge configured to abut a flange of the electronic connector.

3. The electronic connector sealing system of claim 2, the holder and the ledge being U-shaped for positioning the electronic connector in cradling engagement with the holder.

4. The electronic connector sealing system of claim 2, the electronic connector being attached to an electronic circuit board via solder joints, the electronic connector and the flange each having a bottom surface, the ledge having a thickness slightly less than a distance between the bottom surface of the flange and the bottom surface of the electronic connector so that a cleaning solution can pass between the holder and the electronic circuit board and contact the solder joints.

5. The electronic connector sealing system of claim 1, the top plate including a recess configured to at least partially receive the gasket therein and align the gasket over the aperture of the gasket frame.

6. The electronic connector sealing system of claim 1, further comprising a fastener configured to fasten the connector holder, the gasket frame, and the top plate together.

7. The electronic connector sealing system of claim 6, the gasket frame and the top plate each including a through-hole for receiving the fastener therethrough.

8. The electronic connector sealing system of claim 6, the fastener including a distal end, the holder including an anchor hole for receiving the distal end of the fastener therein.

9. The electronic connector sealing system of claim 1, wherein the holder, the gasket frame, the gasket, and the top plate are symmetric so as to evenly distribute forces between left and right sides of the electronic connector.

10. The electronic connector sealing system of claim 1, further comprising a fastener configured to fasten the gasket frame between the top plate and the holder.

11. The electronic sealing system of claim 1, wherein the gasket frame and top plate each have two left inner fastener through-holes and two right inner fastener through-holes, the electronic connector sealing system further comprising four fasteners configured to fasten the gasket frame and the top plate together via the two left inner fastener through-holes and the two right inner fastener through-holes of the gasket frame and top plate so that the gasket is held evenly between the gasket frame and the top plate.

12. The electronic connector sealing system of claim 11, wherein the left inner fastener through-holes and the right inner fastener through-holes of the gasket frame are countersunk, the fasteners being flush-mounted countersunk bolts.

13. The electronic connector sealing system of claim 1, wherein the gasket is rectangular.

14. The electronic connector sealing system of claim 1, wherein the aperture of the gasket frame is rectangular.

15. The electronic connector sealing system of claim 1, wherein the gasket frame and the top plate each have left and right tapered ends.

16. An electronic connector sealing system for sealing an electronic connector, the electronic connector sealing system comprising:

a U-shaped holder having a ledge configured to cradle the electronic connector and left and right opposing anchor holes;

a gasket frame configured to abut the holder, the gasket frame including an aperture configured to receive at least a portion of the electronic connector at least partially therethrough, left and right opposing outer fastener through-holes, and left and right opposing inner fastener through-holes;

a gasket configured to engage the at least a portion of the connector received at least partially through the aperture so as to form a seal between the gasket and the connector; and a top plate configured to abut the gasket frame opposite the holder such that at least a portion of the gasket is positioned between the gasket frame and the top plate, the top plate including left and right opposing outer fastener through-holes and left and right opposing inner fastener through-holes;

a plurality of fasteners configured to fasten the gasket frame to the top plate via the left and right opposing inner fastener through-holes of the gasket frame and the left and right opposing inner fastener through-holes of the top plate; and a plurality of fasteners configured to fasten the connector holder, the gasket frame, and the top plate together via the left and right opposing outer fastener through-holes of the top plate, the left and right opposing outer fastener through-holes of the gasket frame, and the anchor holes of the holder so that the electronic connector is retained with the holder and so that the gasket is retained between the gasket frame and the top plate.

17. The electronic connector sealing system of claim 16, the electronic connector being attached to an electronic circuit board via solder joints, the electronic connector and the flange each having a bottom surface, the ledge having a thickness slightly less than a distance between the bottom surface of the flange and the bottom surface of the electronic connector so that a cleaning solution can pass between the holder and the electronic circuit board and contact the solder joints.

18. The electronic connector sealing system of claim 16, wherein the gasket and the aperture are rectangular.

19. The electronic connector sealing system of claim 16, the top plate further including a recess configured to at least partially receive the gasket therein and align the gasket over the aperture of the gasket frame.

20. An electronic connector sealing system for sealing an electronic connector attached to an electronic circuit board via solder joints, the electronic connector having a flange, the electronic connector and the flange each having a bottom surface, the electronic connector sealing system comprising:

a U-shaped holder having left and right opposing anchor holes and a ledge configured to cradle the electronic connector;

a gasket frame configured to abut the holder, the gasket frame including a rectangular aperture configured to receive at least a portion of the electronic connector at least partially therethrough, left and right opposing outer fastener through-holes, and left and right opposing inner countersunk fastener through-holes;

a rectangular gasket configured to engage the at least a portion of the connector received at least partially through the aperture so as to form a seal between the gasket and the electronic connector;

a top plate configured to abut the gasket frame opposite the holder such that at least a portion of the gasket is positioned between the gasket frame and the top plate, the top plate including left and right opposing outer fastener through-holes and left and right opposing inner fastener through-holes;

a plurality of countersunk bolts configured to fasten the gasket frame to the top plate via the left and right opposing inner countersunk fastener through-holes of the gasket frame and the left and right opposing inner fastener through-holes of the top plate; and a plurality of bolts configured to fasten the connector holder, the gasket frame, and the top plate together via the left and right opposing outer fastener through-holes of the top plate, the left and right opposing outer fastener through-holes of the gasket frame, and the anchor holes of the holder so that the electronic connector is retained with the holder and so that the gasket is retained between the gasket frame and the top plate, the ledge of the U-shaped holder having a thickness slightly less than a distance between the bottom surface of the flange and the bottom surface of the electronic connector so that a cleaning solution can pass between the holder and the electronic circuit board and contact the solder joints.

* * * * *